United States Patent [19]

Minoura

[11] 4,117,816

[45] Oct. 3, 1978

[54] EXHAUST GAS RECIRCULATING SYSTEM FOR USE IN INTERNAL COMBUSTION ENGINE

[75] Inventor: Mikio Minoura, Nagoya, Japan

[73] Assignee: Aisan Industry Co., Ltd., Japan

[21] Appl. No.: 749,325

[22] Filed: Dec. 10, 1976

[30] Foreign Application Priority Data

Dec. 23, 1975 [JP] Japan ..... 50-154503

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,739,797 | 6/1973 | Caldwell | 123/119 A |
| 3,802,402 | 4/1974 | Swatman | 123/119 A |
| 3,877,452 | 4/1975 | Nohira et al. | 123/119 A |
| 3,896,777 | 7/1975 | Masaki | 123/119 A |
| 3,924,589 | 12/1975 | Nohira | 123/119 A |
| 3,926,161 | 12/1975 | Wertheimer | 123/119 A |

FOREIGN PATENT DOCUMENTS

| | | | |
|---|---|---|---|
| 2,365,340 | 11/1974 | Fed. Rep. of Germany | 123/119 A |

*Primary Examiner*—Wendell E. Burns
*Attorney, Agent, or Firm*—Jay L. Chaskin

[57] ABSTRACT

A system for returning part of exhaust gases from an internal combustion engine through a return passage into an intake passage. Provided in the return passage are a fixed orifice, a pressure chamber downstream thereof, and a regulating valve downstream of the chamber. The regulating valve controls the pressure in the pressure chamber for a proper flow rate of exhaust gases being returned or recirculated. An opening of the regulating valve is so designed as to respond to the movement of a pilot valve provided separately. The pilot valve is actuated in response to a pressure in the pressure chamber, a pressure in a venturi portion in a carburetor, and a pressure in an intake passage downstream of a throttle valve, thereby maintaining the pressure in the pressure chamber at the same level as that in the venturi portion, when the pressure in the intake passage downstream of the throttle valve is over a given pressure level, and maintaining the pressure in the pressure chamber higher than the pressure in the venturi portion, when a pressure in the intake passage downstream of the throttle valve is below a given pressure level (at the time of light load running of an engine). Accordingly, the ratio of recirculating exhaust gas to the intake air is maintained constant, when the pressure in the intake passage is over a given pressure level, and reduced when the aforesaid pressure is below the given pressure level (at the time of light load running of an engine.)

5 Claims, 3 Drawing Figures

EXHAUST GAS RECIRCULATING SYSTEM FOR USE IN INTERNAL COMBUSTION ENGINE

This invention relates to an exhaust gas recirculating system for use in an internal combustion engine. Hitherto, there have been proposed many attempts, in which part of exhaust gases is recirculated or returned into an intake passage in an internal combustion engine for the purpose of reducing the amounts of hydrocarbon, carbon monoxide and nitrogen oxides.

One example of the prior art exhaust gas recirculating system includes an exhaust gas return passage connecting an exhaust passage to an intake passage downstream of a carburetor; a fixed orifice provided in the return passage; and a regulating valve provided in a return passage downstream of the aforesaid fixed orifice, while the aforesaid regulating valve functions so as to maintain a pressure prevailing in a space defined between the fixed orifice and the regulating valve at the same pressure level as a vacuum in a venturi portion in the carburetor. Accordingly, the exhaust gas return flow rate is increased or decreased in response to an increase or decrease in a vacuum level in the venturi portion, i.e., an increase or decrease in amount of intake air into an engine, so that a ratio of recirculating exhaust gas to the intake air (hereinafter referred to as "recirculating ratio") will be maintained substantially constant, irrespective of a vacuum level in the venturi portion. However, a satisfactory operation of an engine in the practical application can not be achieved according to a uniform recirculating ratio over an entire load range of an engine. Thus, it is desired that the exhaust gas recirculating ratio be reduced at the time of light load running of an engine.

It is accordingly an object of the present invention to provide an exhaust gas recirculating system for use in an internal cimbustion engine, which may provide a substantially constant exhaust gas recirculating ratio when a load of an engine is over a given level, and reduce the exhaust gas recirculating ratio when the aforesaid load is below a given level.

It is another object of the present invention to provide an exhaust gas recirculating system for use in an internal combustion engine, which includes: an exhaust gas return passage; a fixed orifice provided in the aforesaid passage; a pressure chamber downstream of the orifice; a regulating valve for controlling the pressure in the pressure chamber; and a pilot valve for opening and closing the aforesaid regulating valve in response to a position of the pilot valve itself, the displacement of said pilot valve being adapted to respond to an intake pressure downstream of a throttle valve.

These and other objects and other features of the present invention will be apparent from a reading of the ensuing part of the specification in conjunction with the accompanying drawings which indicate an embodiment of the invention.

Figure 1:
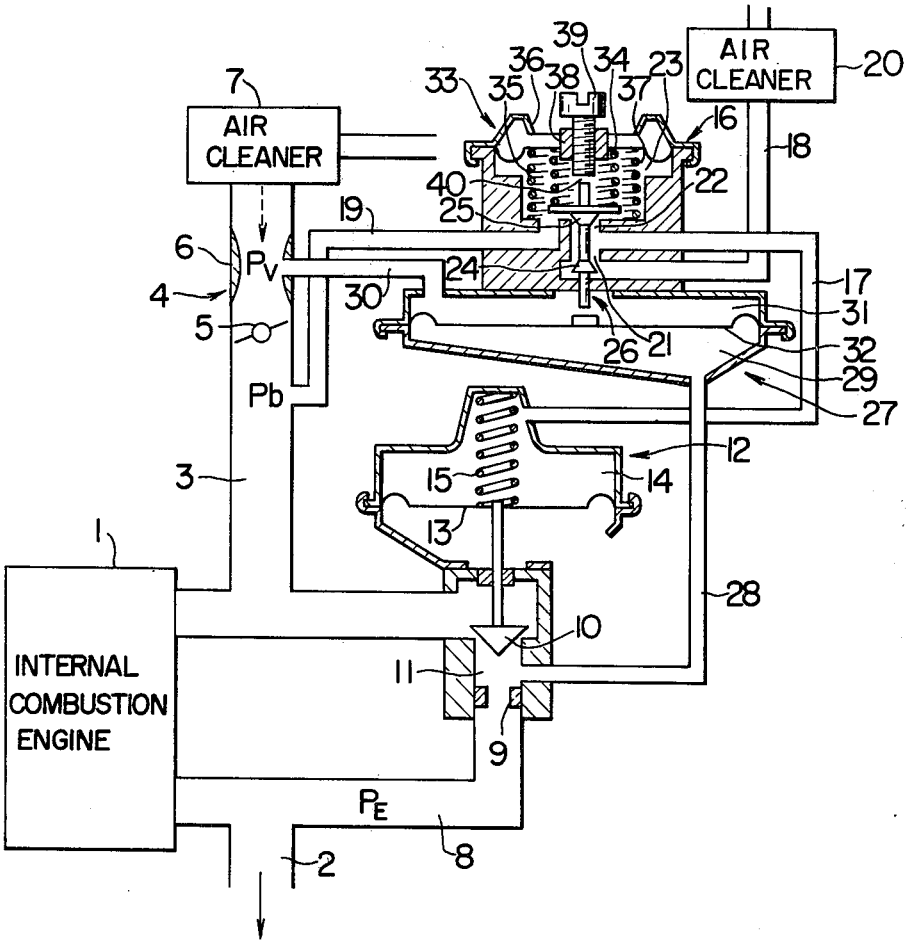
FIG. 1 is a schematic view showing one embodiment of the present invention.

Referring to FIG. 1, an exhaust passage 2 and an intake passage 3 lead to an internal combustion engine 1. Connected to the intake passage 3 are a carburetor 4 including a throttle valve 5 and a venturi portion 6, and an air cleaner 7. Provided between the exhaust passage 2 and the intake passage 3 is an exhaust gas return passage 8, through which part of exhaust gases is supplied into an intake air. A fixed orifice 9 and a regulating valve 10 are provided at a given distance from each other for controlling the flow rate of exhaust gases flowing through the return passage 8, and a pressure chamber 11 is defined therebetween. The regulating valve 10 is positioned downstream of the fixed orifice 9 for controlling the pressure in the pressure chamber 11. The amount or flow rate of exhaust gases which pass through the return passage 8 is proportional to the area of an opening of the fixed orifice 9 as well as to the square root of a difference in pressures prevailing upstream and downstream of the fixed orifice 9. Accordingly, the amount of exhaust gases may be controlled by controlling the pressure in the pressure chamber 11.

A drive means 12 for opening and closing the regulating valve 10 includes a diaphragm 13 having an undersurface leading to atmosphere, and a top surface bounded by a pressure-variable space 14, and a coil spring 15 adapted to urge the diaphragm 13 against the atmospheric pressure. The regulating valve 10 is secured to the diaphragm 13. A vacuum is applied to the aforesaid pressure-variable space 14 from a control means 16 to be described hereinafter. A strength of the coil spring 15 is so predetermined that, when a vacuum level in the pressure-variable space is lower than a given level but substantially equal to the atmospheric pressure, the diaphragm 13 may be deflected so as to bring the regulating valve 10 to its closed position, and when the vacuum level in the pressure-variable space is greater than the given level, then the diaphragm 13 is deflected in the opposite direction so as to bring the regulating valve 10 to its open position.

The control means 16 is provided with first passage 17 communicating with the pressure-variable space 14, a second passage 18 communicating with the atmosphere, a third passage 19 communicating with the intake passage 3 downstream of the throttle valve 5. An air cleaner 20 is connected to the second passage 18. The first passage 17 communicates by way of a first port 21 with the second passage 18, while the first passage communicates by way of a second port 22 and a chamber 23 with the third passage 19. The first port 21 is positioned in alignment with the second port 22. A pilot valve 26 having conical valve bodies 24 and 25 directed in the opposite directions is disposed through the ports 21 and 22 and is movable between a first position where the pilot valve 26 closes the first port 21 and opens the second port 22, and a second position where the pilot valve 26 opens the first port 21 and closes the second port 22. When the pilot valve 26 assumes a lower position, i.e., the second position, the first passage 17 communicates through the first port 21 with the second passage 18, so that an atmospheric pressure is introduced into the pressure-variable space 14, and the regulating valve 10 is maintained in its closed position. On the other hand, when the pilot valve 26 assumes its upper position, i.e., the first position, then a vacuum is introduced from the intake passage 3 via the third passage 19, chamber 23, second port 22, and the first passage 17 to the pressure-variable space 14, so that the diaphragm 13 is deflected upwards due to an atmospheric pressure, thereby opening the regulating valve 10. In this manner, the regulating valve 10 may be opened or closed, depending on the position of the pilot valve 26.

Positioned below the pilot valve 26 is an actuating means 27 for urging the pilot valve 26 upwards i.e., to the first position. The actuating means 27 includes a chamber 29 communicating by way of a passage 28 with the pressure chamber 11, a chamber 31 communicating via a passage 30 with the venturi portion 6 in the carburetor, and a diaphragm 32 interposed between the both chambers 29 and 31. Thus, when the diaphragm 32 is deflected upwards, then the lower end of the pilot valve 26 is pushed upwards by the diaphragm 32.

Positioned above the pilot valve 26 is a biasing means 33 for urging the pilot valve 26 downwards i.e., to the second position. The biasing means 33 includes: a diaphragm 34 having a top surface leading to the atmosphere so as to be subjected to an atmospheric pressure, and an undersurface facing the chamber 23 to be subjected to a vacuum from the intake passage 3 downstream of the throttle valve, thus being adapted to be deflected downwards due to the difference in the aforesaid two levels of pressures; a return spring 35 for urging the diaphragm 34 upwards against the aforesaid pressure difference; an upper stopper 36 for stopping in a given position the diaphragm 34 to move in the direction to be urged by the return spring 35; and a spring 37 confined between the diaphragm 34 and the pilot valve 26. Accordingly, the pilot valve 26 is urged downwards by means of the spring 37, while a force of the spring 37 is varied depending on the displacement of the diaphragm 34 which cooperates with a pressure in the intake passage 3 downstream of the throttle valve 5. The strength of the return spring 35 is so predetermined that when a pressure in the intake passage downstream of the throttle valve 5 is over a given level, the spring 35 overcomes a force or a vacuum acting on the diaphragm 34, thereby urging the diaphragm against the stopper 36, and when the aforesaid pressure in the intake passage 3 is below the given level, i.e., at the time of a light load running of an engine, the spring 35 is overcome by a force or a vacuum acting on the diaphragm 34.

Accordingly, when the level of the pressure acting on the undersurface of the diaphragm 34, that is, the pressure in the intake passage 3 downstream of the throttle valve is below the given level, the diaphragm 34 is deflected downwards to an extent commensurate with the level of the pressure, thereby increasing the urging force of the spring 37 against the pilot valve 26. The stopper 36 is made by bending a metal sheet as shown, so that the position of the stopper 36 may be adjusted by deforming the bent portion of the stopper through a desired angle. The initial reaction of the spring 37 may be adjusted depending on the position of the stopper 36. The position of the stopper 36 is so set that when the diaphragm 34 contacts the stopper 36, a force of the spring 37 is nullified.

Extending through the center of the diaphragm 34 is a block 38 having a threaded center hole piercing therethrough, and a bolt 39 is threaded therein. The bolt 38 has a lower end 40 adapted to abut the top end of the pilot valve 26, so that upon lowering of the diaphragm 34, a force acting on the diaphragm 34 may be transmitted to the pilot valve 26 directly.

Figure 2:
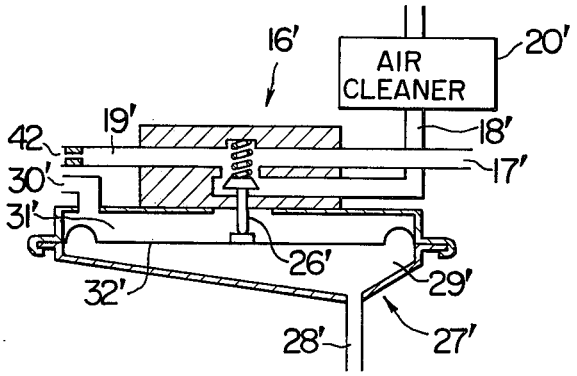
FIG. 2 PRIOR ART
FIG. 2 is a cross-sectional view showing a control means for use with a regulating valve in a prior art exhaust gas recirculating system.

FIG. 2 shows a prior art control means 16' for use in controlling a pressure in the pressure variable space 14 in the regulating-valve drive means 12. According to this control means 16', a first passage 17' communicates with the pressure-variable space in the regulating-valve drive means 12 and communicates with a third passage 19' having an orifice 42, which in turn communicates with the intake passage downstream of a throttle valve, while communicating by way of a pilot valve 26' with a second passage 18' which in turn communicates via an air cleaner 20' with the atmosphere. The movement of the pilot valve 26' is controlled by an actuating means 27' which includes a chamber 29' communicated by way of a passage 28' with the pressure chamber 11, a chamber 31' communicating by way of a passage 30' with the venturi portion 6, and a diaphragm 32' interposed between the chambers 29' and 31'. In the control means 16' when a pressure in the pressure chamber becomes higher than a pressure in the venturi portion, then the diaphragm 32' is deflected upwards to move the pilot valve upwards, thereby blocking the communication between the first passage 17' and the second passage 18'. As a result, a vacuum in the pressure variable space 14 is increased, (an absolute pressure is decreased), and thus the regulating valve 10 is opened so that a pressure in the pressure chamber 11 is lowered. In this manner, the pressure may be maintained substantially at the same level as that of a pressure in the venturi portion. According to the prior art control means, the pilot valve 26' has been controlled by a venturi pressure and a pressure in the pressure chamber, alone.

In contrast thereto, according to the device shown in FIG. 1, the movement of the pilot valve is controlled by a pressure in the intake passage in addition to a venturi pressure and a pressure in the pressure chamber, so that the pressure in the pressure chamber 11 is influenced by the pressure in the intake passage 3. The control performance with the embodiment of FIG. 1 will be described hereinafter, referring to FIG. 3.

Figure 3:
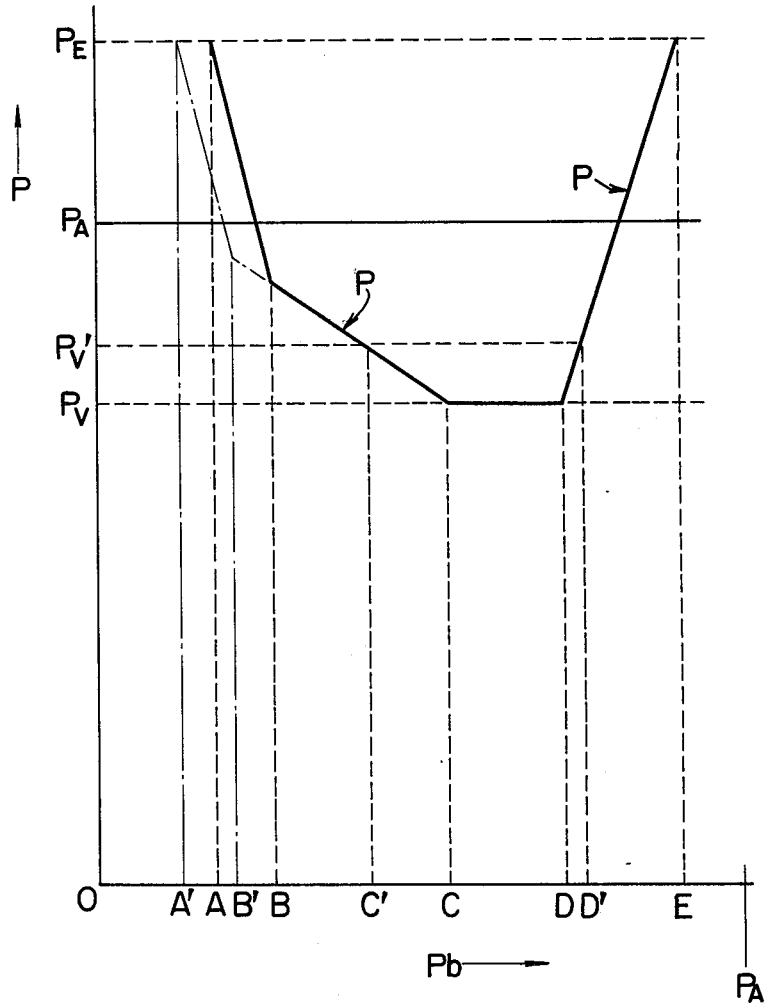
FIG. 3 is a plot illustrative of the performance of the embodiment of FIG. 1.

A pressure in the exhaust passage 2 is designated by $P_E$, a pressure in the venturi portion by $P_V$, a pressure in the intake passage 3 downstream of the throttle valve 5 by P*b*, a pressure in the pressure chamber 11 by P and the atmospheric pressure by $P_A$ (P, $P_A$, $P_V$, $P_E$ and P*b* are all in absolute pressure). FIG. 3 shows a relationship between the intake passage pressure Pb and the pressure chamber pressure P when the opening of the throttle valve 5 is changed gradually while maintaining the engine 1 at a constant running condition where $P_E$ and $P_V$ are maintained substantially constant when the pressure P*b* in the intake passage 3 is higher than a given pressure (a pressure level given at C in FIG. 3), i.e., a vacuum ($P_A$ − P*b*) is small, the diaphragm 34 is maintained in contact with the upper stopper 36, remaining still thereat. In this condition, a force of the spring 37 is maintained constant, so the movement of the pilot valve 26 is controlled by the actuating means 27 as in the case of the prior art control means given in FIG. 2. When the pressure P in the pressure chamber 11 is higher than the pressure $P_V$ in the venturi portion 6, then the diaphragm 32 urges the pilot valve 26 to its upper position, thus allowing introduction of the pressure P*b* from the intake passage into the pressure-variable space 14, with the result that the regulating valve 10 is opened and the pressure in the pressure chamber 11 is lowered. In this manner, the pressure P in the pressure chamber may be brought to the same level as that of the pressure $P_V$ in the venturi portion. This condition may be maintained, until the pressure P*b* in the intake passage 3 is increased to a pressure level given at a point D. When the pressure P*b* is further increased, then a vacuum acting on the pressure-variable space 14 in the regulating-valve drive means 12 is decreased, with an accompanying decrease in the force to urge the diaphragm 13 upwards.

For this reason, the pressure P in the pressure chamber is increased with an increase of the pressure P*b* in the intake passage, as shown by a range DE, eventually to the same level as that of the pressure $P_E$ of exhaust gases.

Conversely, when the pressure P*b* in the intake passage 3 is lower than a level at a point C, and thus the vacuum ($P_A$ − P*b*) becomes large, then the diaphragm 34 is lowered against a force of the return spring 35, thereby increasing a force acting on the pilot valve 26 downwards, by the medium of the spring 37. As a result, as shown in a range CB in FIG. 3, the pressure P in the pressure chamber is increased with a decrease in the pressure P*b* in the intake passage. The pressure shown at a point B is the pressure resulting when the lower end 40 of the bolt 39 retained by the diaphragm 34 abuts the top end of the pilot valve 26.

When the pressure P*b* in the intake passage is lower than the pressure at the point B, then the top end of the pilot valve 26 remains contacting the lower end of the bolt 39 all the times. As a result, the pilot valve 26 directly bears a force acting on the diaphragm 34. Accordingly, as shown in a range BA in FIG. 3, the pressure P in the pressure chamber sharply increases with a decrease of the pressure P*b* in the intake passage.

The position of the upper stopper 36 which defines the upper limit of the movement of the diaphragm 34 may be adjusted by using the bent portion thereof. When the upper stopper 36 is lowered, then the initial elastic force of the spring 37 is increased. As a result, the diaphragm 34 contacts the upper stopper 36 at a point C′ in FIG. 3, while the pressure P in the pressure chamber is controlled to a pressure $P'_V$ which is somewhat higher than the pressure in the venturi portion, in a range C′–D′.

The position of the lower end 40 of the bolt 39 may be adjusted by rotating the bolt 39. Thus, when the bolt 39 is shifted upwards, then A,B are shifted to A′, B′. As a result, the pressure P*b* in the intake passage 3 for interrupting the exhaust gas recirculation is shifted from the point A to the point A′, thereby interrupting exhaust gas recirculation at the time of idle running, deceleration and a normal running under a light load of an engine.

The amount of exhaust gases being recirculated is proportional to the square root of a difference in the pressures ($P_E$-P) prevailing upstream and downstream of the fixed orifice 9, and hence to the square root of a vertical distance between the line $P_E$ and the line P in FIG. 3. As a result, the amount of the recirculating exhaust gases may be adjusted to an optimum level, when the pressure P*b* in the intake passage is low, i.e., at the time of light load running of an engine.

When the amount of recirculating exhaust gases at the time of light load running of an engine is reduced or nullified, (recirculation is interrupted), then the condition of an engine at the time of a light load running, and hence drivability of a motor vehicle may be improved, and an emission value of exhaust gases is also improved. The optimum relationship between the pressure $P_E$ in the exhaust passage 5 and the amount of recirculating exhaust gases may be achieved by suitably selecting an area of the diaphragm 34, spring constants and initial reactions of return spring 35 and spring 37 and an extent of the bolt 39 to be lowered.

As is apparent from the foregoing description, the exhaust gas recirculation system according to the present invention may achieve the intended objects and improves the operational performance of an internal combustion engine.

What is claimed is:

1. An exhaust gas recirculating system for use in an internal combustion engine, comprising:

an exhaust gas return passage interconnecting the exhaust passage and the intake passage to said internal combustion engine;

a carburetor communicating with said intake passage, said carburetor having a throttle valve and a venturi portion;

a fixed orifice provided in said exhaust gas return passage;

a regulating valve provided in said exhaust gas return passage downstream of said fixed orifice and controlling the pressure in a pressure chamber defined between said regulating valve and said fixed orifice;

a regulating valve drive means having a pressure-variable space for actuating said regulating valve in response to the pressure in said space; and a control means for controlling the pressure in said pressure-variable space, said control means including: a first passage communicating with said pressure-variable space; a second passage communicating with the atmosphere; a third passage communicating with said intake passage downstream of said throttle valve in said carburetor; a first port for bringing said first passage into communication with said second passage; a second port for bringing said first passage in communication with said third passage; a pilot valve movable between a first position to close said first port and open said second port, and a second position to open said first port and close said second port; means for urging said pilot valve toward said first position in resonse to a difference between a pressure in said pressure chamber and a pressure in said venturi portion of said carburetor; a spring means for urging said pilot valve toward said second position at all times; and means for increasing a force of said spring means, depending on a reduction in pressure in said intake passage downstream of said throttle valve when the pressure in said intake passage becomes lower than a given pressure level.

2. An exhaust gas recirculating system for use in an internal combustion engine, comprising:

an exhaust gas return passage interconnecting the exhaust passage and the intake passage to said internal combustion engine;

a carburetor communicating with said intake passage, said carburetor having a throttle valve and a venturi portion;

a fixed orifice provided in said exhaust gas return passage;

a regulating valve provided in said exhaust gas return passage downstream of said fixed orifice and controlling the pressure in a pressure chamber defined between said regulating valve and said fixed orifice;

a regulating valve drive means having a pressure-variable space for actuating said regulating valve in response to the pressure in said space; and a control means for controlling the pressure in said pressure-variable space, said control means including: a first passage communicating with said pressure-variable space; a second passage communicating with the atmosphere; a third passage communicating with said intake passage downstream of said throttle valve in said carburetor; a first port for bringing said first passage into communication with said second passage; a second port for bringing said first passage in communication with said third passage; a pilot valve movable between a first position to close said first port and open said second port, and a second position to open said first port and close said second port; means for urging said pilot valve toward said first position in response to a difference between a pressure in said pressure chamber and a pressure in said venturi portion of said carburetor; and means for biasing said pilot valve toward said second position at all times, said biasing means including a diaphragm spaced a distance from the end of said pilot valve in the vicinity of said second port at a right angle to said pilot valve, one surface of said diaphragm which faces said pilot valve being subjected to the pressure in said intake passage downstream of said throttle valve, and the other surface of said diaphragm being subjected to the atmospheric pressure, a first spring means for urging said diaphragm against the atmospheric pressure, and a second spring means confined between said diaphragm and said pilot valve.

3. An exhaust gas recirculating system as set forth in claim 2, further comprising a stopper means for limiting the movement of the diaphragm, said stopper means being positioned in the vicinity of said diaphragm and on the side to face the atmosphere.

4. An exhaust gas recirculating system as set forth in claim 3, further comprising means retained by said diaphragm for directly contacting said pilot valve, when said diaphragm is moved towards said pilot valve, thereby transmitting a force from said diaphragm to said pilot valve directly.

5. An exhaust gas recirculating system as set forth in claim 4, wherein said means retained by said diaphragm is retained in the center of said diaphragm and includes a block having a center threaded hole piercing therethrough, and a threaded member which engages said threaded hole and has an end for contacting said pilot valve.

* * * * *